United States Patent [19]

Settembre

[11] 4,348,036

[45] Sep. 7, 1982

[54] SAFETY BINDING FOR NORDIC SKIS

[76] Inventor: Richard J. Settembre, 714 Velasko Rd., Syracuse, N.Y. 13207

[21] Appl. No.: 179,503

[22] Filed: Aug. 19, 1980

[51] Int. Cl.[3] ..... A63C 9/08

[52] U.S. Cl. ..... 280/615; 292/46; 292/DIG. 49

[58] Field of Search ..... 280/614, 615, 623; 292/DIG. 49, 52, 46

[56] References Cited

U.S. PATENT DOCUMENTS 4,184,696 1/1980 Settembre ..... 280/615

FOREIGN PATENT DOCUMENTS 163752 8/1949 Austria ..... 280/615

2706111 8/1978 Fed. Rep. of Germany ..... 280/615

*Primary Examiner*—Joseph F. Peters, Jr.

*Assistant Examiner*—Michael Mar

*Attorney, Agent, or Firm*—Bruns & Jenney

[57] ABSTRACT

A safety binding for cross country skis that is capable of releasing a ski boot when the binding is overstressed by forces acting in any direction. The binding includes a boot mounted toe piece capable of being mounted upon the skier's boot that has a pair of laterally opposed open faced sockets formed therein and a ski piece having a pair of ball-like members mounted upon coating scissor arms. The ball members are laterally receivable within the socket openings when the scissor arms are moved from an open position toward a closed position thereby securing the toe piece to the ski piece. A biasing means acts between the arms of the scissors to urge the ball members into the closed position and thus hold the boot of the skier to the ski with a predetermined amount of force. Overcoming the holding force in any direction will cause the scissors to open and thus release the boot from the ski.

11 Claims, 3 Drawing Figures

SAFETY BINDING FOR NORDIC SKIS

BACKGROUND OF THE INVENTION

This invention relates to a cross country ski binding and, in particular, to a releasable cross country ski binding that will enable the skier's boot to separate from the ski when the binding is overstressed from any direction.

As noted in U.S. Pat. No. 4,184,696, a greater attention is now being paid to the safety of cross country ski bindings. It has been the popular opinion that cross country skiing is a relatively safe sport. However, a number of studies have shown it to be a more hazardous activity than originally thought primarily because of the inability of most bindings to release in the event of a fall or the like. The typical touring ski binding involves a series of raised pins that are mounted on the ski and which are adapted to securely engage the boot of the skier. The binding is designed to permit the boot to be flexed while at the same time allowing the skier to impart a forward thrust to the ski to propel the ski over the snow along a desired track. However, this type of binding will not release the boot from the ski when it is overstressed, as for example, when the skier experiences a fall. Accordingly, serious injury can be done to the skier's leg.

In the noted patent, a binding is disclosed which permits the skier's boot to be released during the course of a lateral or "slow turning fall". Although this improved binding certainly goes a long way towards improving the safety of cross country skiing, it does not allow for boot release if the binding is overstressed in a direction other than laterally.

SUMMARY OF THE INVENTION

An object of this invention is to further improve cross country ski bindings.

A further object of this invention is to improve the safety features of cross country ski bindings without sacrificing performance.

Yet another object of the present invention is to provide a cross country ski binding that can release when overstressed in any direction.

Another object of the present invention is to provide a cross country ski binding that not only is capable of releasing when stressed in any direction but which can also be easily adjusted to set the bindings' release tension.

A still further object of the present invention is to provide a universally releasable binding for cross country skis that is capable of delivering an extremely stable performance.

Still another object of the present invention is to provide a safety binding for cross country skiing that enables the skier to apply a downward pressure on the ski tips while at the same time allowing the boot to release from the ski when the binding is overstressed in any direction.

These and other objects of the present invention are attained by means of a releasable cross country ski binding that includes a boot mounted toe piece containing a pair of laterally opposed open faced sockets formed therein, a ski piece having a pair of scissor arms pivotably mounted therein which are arranged to move a pair of ball members into and out of seating contact with the sockets so as to releasably secure the boot to the ski and a biasing means acting upon the scissor arm to continually urge the ball members into the socket opening under a predetermined pressure.

BRIEF DESCRIPTION OF THE DRAWINGS

For a better understanding of the present invention and further features thereof, reference is had to the following detailed description which is to be read in conjunction with the accompanying drawings, wherein.

DESCRIPTION OF THE INVENTION

Figure 1:
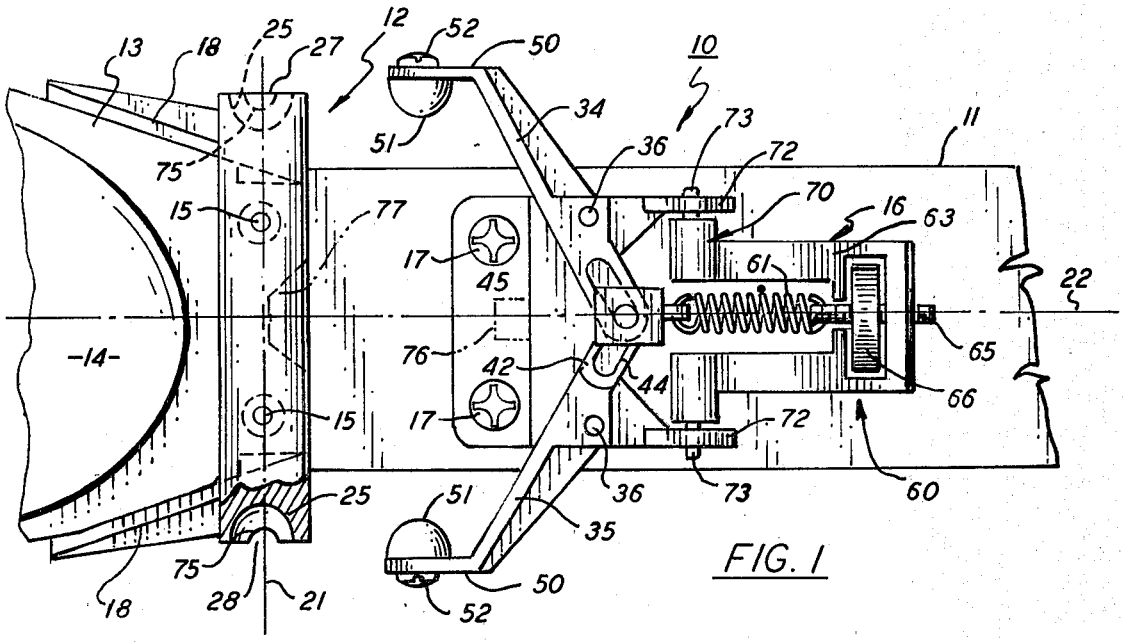
FIG. 1 is a partial top view of a ski binding encompassing the teachings of the present invention showing the toe piece of the binding detached from the ski piece.

With further reference to the drawings, there is shown a releasable safety binding, generally referenced 10, that is ideally well suited for use in conjunction with a touring or cross country ski 11. The present binding contains two main sections. These include a toe piece 12, which is secured to the sole 13 of boot 14 by means of screws 15—15, and a ski piece 16 that is secured to the top surface of the ski by means of screws 17—17. The toe piece is shown in the drawings disconnected from the ski piece. However, as will be described in greater detail below, the two pieces are brought together in assembly to provide a releasable joint between the skier's boot and the ski.

The toe piece is provided with a pair of raised wings 18—18 that pass obliquely back from the cylindrically shaped main body section 20 thereof. The wings serve to position the binding piece with reference to the boot and also helps the binding to resist lateral stresses that might be exerted thereon. The main body of the toe piece is situated upon a centerline 21 which, when the boot is joined to the ski, lies generally normal to the central axis 22 of the ski. A pair of laterally opposed sockets 25—25 having oval shaped openings are formed in the two end faces 27 and 28 of the main body section. The sockets are both centered along the centerline 21 of the body section and are adapted to open outwardly to both sides of the boot. The major axis 29 of each oval shaped socket opening is generally vertically aligned in reference to the horizontal top surface of the ski. The purpose of this arrangement will be explained in greater detail below.

Figure 3:
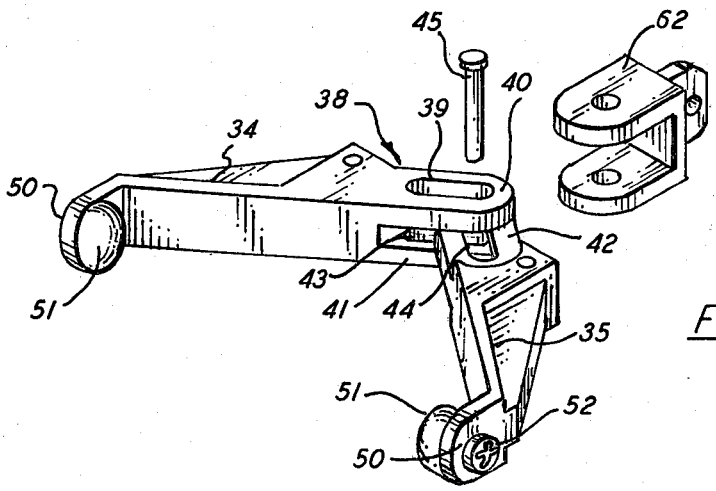
FIG. 3 is a perspective view of the coacting scissor arms used in the present binding and a clevis and pin assembly for operatively connecting the scissor arms to a biasing means.

The ski piece 11 contains a unitized base 30 having a raised pedestal 31 extending across the midsection thereof. In assembly, the base of the ski piece is centered upon the axis 22 of the ski and securely held against the top surface 32 of the ski via the previously mentioned screws 17—17. A pair of coacting scissor arms 34 and 35 are rotatably supported upon the top of the pedestal by means of laterally aligned spaced apart pivot pins 36—36. As best seen in FIG. 3, the proximal end of arm 34 terminates in a bifurcated section 38 that has an elongated hole 39 passing through both legs 40,41 thereof. The proximal end of the other scissor arm 35 terminates in an extended medial rib 42 that passes into the slot 43 formed between the two legs of the bifurcated end section of the other arm. The medial rib also contains a second elongated hole 44 which, in assembly, crosses that formed in the legs of the other arm. A clevis pin 45 is passed downwardly through the slotted holes contained in both members. In operation, the clevis pin serves to coordinate the motion of the two arms so that they move uniformly about the central axis of the ski between a first fully open position and a second closed position. The arms as shown in FIG. 1 are in the closed position.

The distal end of each arm contains a depending pad 50 which is supported in generally parallel alignment with the adjacent side edge of the ski when the scissors are in the closed position as shown in FIG. 1. The pads are circular in form and each has an oval shaped ball member 51—51 securely affixed by means of screws 52 to the inner surface thereof, that is, the surface that faces the ski. Each ball member 51 is an oval shaped hemisphere that has an outer contour which compliments the inner wall of the receiving socket. Here again, the major axis 56 of the oval shaped member is generally normal to the top surface of the ski so that when the toe piece is mated to the ski piece, each ball member will be securely seated within the associated socket.

Figure 2:
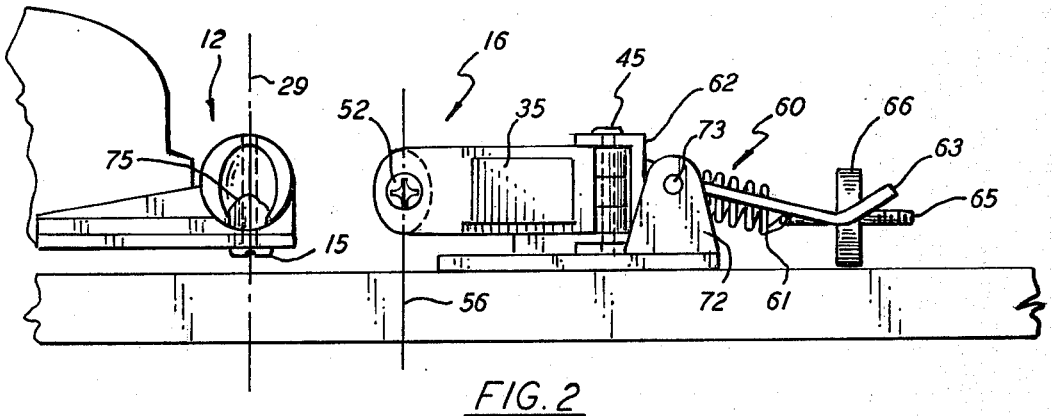
FIG. 2 is a side elevation of the ski binding shown in FIG. 1.

An adjustable tensioning mechanism, generally referenced 60, is located upon the ski piece toward the forward or tip end of the base. The mechanism includes a tension spring 61 that is connected at its back end to the previously noted clevis pin 45 via a clevis 62. The other end or front end of the spring is adjustably connected to a release frame 63 by means of a threaded stud 65. The stud is threaded into a knurled thumbnut 66 as illustrated in FIGS. 1 and 2. The thumbnut, in turn, is rotatably secured within the frame. By turning the nut, the tension upon the spring can be increased or decreased as desired. This, of course, controls the amount of pressure that is applied to the scissor arms and thus regulates the amount of overstress that is required to release the ski piece from the toe piece.

The release frame is a generally bifurcated element having a pair of cylindrical shaped bearing blocks 70—70 formed at the terminal end of each of its arms. The bearing blocks are rotatably supported by means of hinge pins 73—73 between a pair of raised stanchions 72—72 connected to the base of the ski piece. In operation, the frame acts as an over center locking device which, when placed in the locked position as illustrated in FIGS. 1 and 2, causes the tension spring to exert a continuous biasing force against the scissor arm to urge the arms into a fully closed position. However, when the frame is rotated upwardly away from the top surface of the ski, the spring is raised above the center of the hinger pins. As a consequence, the tension exerted by the spring on the scissors is relieved permitting the arms to freely move back away from side edges of the ski into an open position. The overcentered frame mechanism provides a convenient means by which the skis can be rapidly and conveniently clamped to or released from the boot.

To further facilitate mating of the two binding pieces, a small cusp shaped recess 75 is cut into the bottom wall of each socket. The recess is centered upon the major axis of the oval shaped opening and is contoured so that a ball member entering the socket will be automatically guided into the opening. This permits the skier to place the sockets of the toe piece over the balls of the ski piece and simply step down into the binding when putting the skis on. In practice, the inner wall of the socket can be lined or formed of polycarbonate while the ball members can be made of delrim. These two materials both exhibit low friction characteristics, while at the same time delivering high strength, to permit the ball members to slide easily into the receiving sockets. Because both the ball and socket are oval in form, the joint formed thereby will tend to resist any rotational motion imparted thereto by the boot as the skier propels the ski forward. This feature, combined with the spring's tension acting on the scissors, allows the skier to exert sufficient downward pressure upon the ski tips to guide the skis along a desired track as typically demonstrated when executing a normal cross country stride.

Although it is not deemed essential to the practice of the present invention, a pressure exerting tab may also be added to the binding that acts between the ski piece and the toe piece to apply added forward pressure to the ski tip. Such a device is shown in phantom outline in FIG. 1 and consists of a flexible tab 76 that is secured in the pedestal of the toe piece base. The tab extends rearwardly from the base toward the toe piece and is capable of being slidably received in an over-sized slot 77 cut into the front wall of the toe piece. When the boot is flexed, the top wall of the slot engages the top surface of the flexible tab and a downward pressure is generated that further helps in pressuring the ski tip. Sufficient clearance is provided in the slot 77 to enable the toe piece to easily separate from the ski piece when the binding is released. It should be noted that when the pressure tab is used, the toe piece must be brought horizontally into and out of engagement with the ski piece when putting on or taking off the skis. This may make the skis slightly more difficult to get into and out of but will not adversely affect the performance of the binding.

As should be evident from the disclosure above, the present safety ski binding permits separation of the toe piece from the ski piece when the binding is overstressed by boot generated forces regardless of the vectorial reaction of these forces. Accordingly, the binding is capable of providing greater protection to the skier during a fall or when the ski becomes entangled in foreign materials such as rocks, underbrush or the like.

While this invention has been described with reference to the structure disclosed herein, it is not confined to the details as set forth and this application is intended to cover any modifications or changes as may come within the scope of the following claims.

I claim:

1. A safety binding for use in conjunction with a cross country ski including a toe piece that is adapted to be secured to the front of a ski boot, said toe piece further having a pair of opposed open faced sockets that are oval in form and which lie along a common centerline that will be normal to the central axis of the boot, a ski piece that is adapted to be secured to the top surface of a ski that further includes a pair of coacting scissor arms pivotably mounted therein so that the distal ends of the arms move between an open and a closed position in a plane that is generally parallel with the top surface of the ski, a biasing means acting upon the scissor arms for urging the distal ends of the arms towards said closed position, and an oval shaped ball member affixed to the distal end of each arm, said ball members being arranged to move with the arms towards each other when the arms are moved toward said closed position, said ball members having a shape that compliments the inner surface of the sockets and being capable of being received therein as the arms are moved towards said closed position thereby securing the toe piece of the binding to the ski piece, both the oval shaped ball and socket having a major axis that is generally perpendicular to the top surface of the ski when the two are brought together in assembly.

2. The apparatus of claim 1 wherein said biasing means is a tension spring acting on the proximal ends of the scissor arms.

3. The apparatus of claim 2 wherein the spring is secured at one end to the scissor arms and at the opposite end to a frame that is rotatably supported by a hinge means in the ski piece so that it moves between a first locking position in which the spring is extended to urge the arms into a closed position, and a release position wherein the spring is relaxed thereby relieving the pressure on the arms.

4. The ski binding of claim 3 wherein said opposite end of the spring is secured to the frame by a manually operated adjusting means for regulating the tension exerted by the spring on the arms when the frame is in the locking position.

5. The ski bindings of claim 1 wherein the lower inner surface of each socket has a cusp formed at the open end thereof to facilitate entry of the ball member therein.

6. The ski binding of claim 1 that further includes a resilient means arranged to act between the toe piece and the ski piece when the ball members are seated within the sockets to apply a downward pressure on the ski tips when the binding experiences a forward thrust from the boot.

7. The ski binding of claim 1 wherein the surfaces of the ball members and the sockets are both formed of a low friction material to permit the surface of the ball member to move freely against the contacting surface of the receiving socket.

8. The ski binding of claim 3 wherein the proximal ends of the scissor arms cross each other in an overlying relationship and have elongated slotted holes formed therein, an actuating member passing through the elongated slotted holes formed in both arms, and connecting means for joining the actuating means to said one end of said spring whereby the arms move uniformly about the central axis of the ski when urged into a closed position by the spring.

9. The ski binding of claim 8 wherein said actuating means is a pin and said connecting means is a clevis.

10. A cross country ski binding that includes a toe piece having a pair of opposed oval sockets formed therein with each socket having a major axis lying in a generally vertical plane and means for securing the toe piece to a boot so that the sockets open to either side of said boot, a ski piece having a pair of coacting scissor arms mounted by pivot means therein that are adapted to move a complimentary pair of oval shaped ball members secured in the distal end of said arms into and out of engagement with the sockets to releasably secure the ski piece to the toe piece, and a biasing means acting between the two scissor arms to hold the ball members in seating engagement within the sockets under a predetermined pressure.

11. A cross country ski binding that includes a toe piece having means for securing said toe piece to a boot, a ski piece having a pair of co-acting arms pivotably mounted therein, a pair of opposed oval shaped sockets having a major axis lying in a generally vertical plane mounted in one of said pieces and a complimentary pair of oval shaped ball members secured in the other of said pieces that are adapted to move into and out of engagement to releasably secure the ski piece to the toe piece as the arms are moved toward and away from each other, and a biasing means acting between the two arms to hold the ball members in seating engagement within the sockets under a predetermined pressure.

* * * * *